US009054468B2

(12) United States Patent
Chang

(10) Patent No.: US 9,054,468 B2
(45) Date of Patent: Jun. 9, 2015

(54) ELECTRICAL CONNECTOR STRUCTURE

(71) Applicants: U. D. ELECTRONIC CORP., Taoyuan (TW); U. D. (ZHONG JIANG) ELECTRONIC CORP., Deyang/Sichuan (CN); DONGGUAN JIAN GUAN PLASTIC ELECTRONIC CO., LTD., Dongguan/Guangdong (CN)

(72) Inventor: Chih-Kai Chang, Taoyuan (TW)

(73) Assignees: U. D. ELECTRONIC CORP. (TW); U. D. (ZHONG JIANG) ELECTRONIC CORP. (CN); DONGGUAN JIAN GUAN PLASTIC ELECTRONIC CO., LTD. (CN)

( * ) Notice: Subject to any disclaimer, the term of this patent is extended or adjusted under 35 U.S.C. 154(b) by 0 days.

(21) Appl. No.: 14/191,716

(22) Filed: Feb. 27, 2014

(65) Prior Publication Data

US 2014/0295707 A1 Oct. 2, 2014

(30) Foreign Application Priority Data

| | | |
|---|---|---|
| Mar. 29, 2013 | (CN) | 2013 2 0152093 U |
| Mar. 29, 2013 | (CN) | 2013 2 0152104 U |
| Mar. 29, 2013 | (CN) | 2013 2 0152105 U |
| Mar. 29, 2013 | (CN) | 2013 2 0152106 U |
| Mar. 29, 2013 | (CN) | 2013 2 0152107 U |
| Mar. 29, 2013 | (CN) | 2013 2 0152978 U |

(51) Int. Cl.
*H01R 13/717* (2006.01)
*H01R 24/64* (2011.01)

(52) U.S. Cl.
CPC ..... *H01R 13/7175* (2013.01); *H01R 24/64* (2013.01)

(58) Field of Classification Search
USPC ..... 439/541.5, 676, 490, 488, 668, 669, 439/540.1, 620.18, 620.24
See application file for complete search history.

(56) References Cited

U.S. PATENT DOCUMENTS

| | | | | |
|---|---|---|---|---|
| 5,639,267 | A * | 6/1997 | Loudermilk | 439/701 |
| 7,153,158 | B1 * | 12/2006 | Lee | 439/541.5 |
| 7,241,181 | B2 * | 7/2007 | Machado et al. | 439/676 |
| 7,510,441 | B2 * | 3/2009 | Zhang et al. | 439/620.18 |
| 7,517,254 | B2 * | 4/2009 | Zhang et al. | 439/668 |
| 7,674,136 | B2 * | 3/2010 | Steinke et al. | 439/676 |
| 7,712,941 | B2 * | 5/2010 | Tai et al. | 362/581 |
| 7,775,828 | B2 * | 8/2010 | Zhang | 439/540.1 |
| 7,837,511 | B2 * | 11/2010 | Hsu | 439/669 |
| 8,206,019 | B2 * | 6/2012 | Chen et al. | 362/581 |
| 8,215,982 | B2 * | 7/2012 | Bu et al. | 439/490 |
| 8,337,246 | B2 * | 12/2012 | Zhang | 439/607.01 |
| 8,403,701 | B2 * | 3/2013 | Han et al. | 439/541.5 |
| 8,449,332 | B2 * | 5/2013 | Purkis et al. | 439/620.18 |
| 8,579,661 | B2 * | 11/2013 | Zhang | 439/607.01 |
| 8,636,540 | B2 * | 1/2014 | Bu | 439/490 |
| 2001/0000767 | A1 * | 5/2001 | Ezawa et al. | 439/490 |
| 2007/0155223 | A1 * | 7/2007 | Huang et al. | 439/490 |

* cited by examiner

*Primary Examiner* — Alexander Gilman

(57) ABSTRACT

The present invention relates to an electrical connector structure, wherein the electrical connector structure according to the present invention includes: a housing, a plurality of electrical modules, and a plurality of LED modules, and the plurality of electrical modules and the plurality of LED modules are disposed in the housing. Moreover, the primary objective of the present invention is to provide an electrical connector structure, which reduces the difficulty of assembling and manufacturing costs for an electrical connector by improving the structure inside the electrical connector; moreover, the present invention increases the production efficiency and the safety of the product so as to improve the assembly quality and the process of production.

24 Claims, 12 Drawing Sheets

12

127

133

135

ELECTRICAL CONNECTOR STRUCTURE

BACKGROUND OF THE INVENTION

1. Field of the Invention

The present invention relates to an electrical connector, and more particularly, to an improvement of an electrical connector structure.

2. Description of the Prior Art

Nowadays, with the advancement of computer technology, laptop and desktop computers exist everywhere in our society, wherein the advancement of computer technology is major in improving the computing function, the speed, and the size of computer; moreover, the living, learning, working and recreation of human being have been led to a whole new level by connecting computer to internet, therefore, computer and internet play indispensable roles in modern life.

Wherein electrical connector is the key for connecting computer to internet; with the advancement of computer technology, the size of electrical connector has been reduced significantly; moreover, with the growing demand of network transmission, electrical connectors have been developed into various forms to meet various requirements. For instance, hub is widely applied in various fields as one of productions that assemble multiple electrical connectors in the structure for providing users to create a local area network.

However, conventional electrical connector or hub still has the following disadvantages:

1. Conventional electrical connector disposes RJ terminals via the way of insert molding, however, resisted by bended structure of RJ terminals nowadays, the welding position of RJ terminals could be nowhere but on the center of PCB board; therefore, the space in the electrical connector could not be used efficiently such that the electrical connector could not be downsized.

2. The pins of the capacitances of conventional electrical connector are pulled out and welded on the housing for grounding. In this kind of structure, the pins of the capacitances need to be aligned the welding holes of housing for completing the productive process, such that the time of assembly would be increased and the production efficiency would be seriously reduced.

3. The LED terminals of conventional electrical connector are disposed between input terminals and position-limiting board, therefore, one more PCB board is needed to be disposed on the front side of electrical module for installing LED components and the pins of LED terminals since the position restrictions of the input terminals and the welding positions on PCB board, such that the difficulty and the cost of manufacturing electrical connectors are relatively high.

4. The density of the electrical connector structure inside conventional hub is increase for installing more RJ terminal connectors; therefore, short circuit would easily occur when the RJ terminal modules are too close to each other, so as to cause problems of equipment damage and using safety.

5. In the process of manufacturing conventional electrical connectors, a pair of LED fixed boards are combined and installed into the housing; in addition, a plurality of LED terminals is bent into a particular shape and installed top-down into the corresponding spaces of the combined LED fixed boards. In this way, the LED terminals need to be bent for many times for the particular shape, such that the production efficiency is reduced and the production cost is increased; moreover, the LED terminals are too long to install the combined LED fixed boards easily and result in the difficulty of assembling is increased.

6. The supporting board with position-limiting holes of conventional electrical connector is designed for the electrical terminals of the electrical module, and the producer need to prepare another supporting board for the LED terminals of the LED module. Since the difference between the supporting boards, assembly errors and cracks easily occurred between adjacent supporting boards during assembling, therefore, the assembling quality would be reduced.

Accordingly, in view of the conventional electrical connector still have some shortcomings and drawbacks, the inventor of the present application has made great efforts to make inventive research thereon and eventually provided an electrical connector structure.

SUMMARY OF THE INVENTION

The primary objective of the present invention is to provide an electrical connector structure, which reduces the difficulty of assembling and manufacturing costs for an electrical connector by improving the structure inside the electrical connector; moreover, the present invention increase the production efficiency and the safety of the product so as to improve the assembly quality and the process of production.

Accordingly, to achieve the above objectives of the present invention, the inventor proposes an electrical connector structure, comprising:

a housing, comprising at least one accommodating space and at least one receiving space, and the housing further comprising a back shielding cover and a position-limiting board disposed on the bottom thereof;

at least one electrical module, being disposed in the at least one accommodating space corresponding to the at least one receiving space; and at least one LED module, being disposed in the at least one accommodating space;

wherein each electrical module comprises:

two PCB boards, being respectively formed with a plurality of welding notches;

a terminal base, being disposed between the two PCB boards, and located on the front edge of the two PCB boards;

a plurality of RJ terminals, being disposed on the upside and the downside of the terminal base, wherein one end of the plurality of RJ terminals are extended out of the two lateral sides of terminal base from the internal of the terminal base, and the other end of the RJ terminals being exposed out of the upside and the downside of the terminal base;

a spacing block, being disposed on the front side of the terminal base;

a plurality of capacitances, being disposed on the PCB boards, and located on the upper side of the two PCB boards, wherein the pins of the plurality of capacitances electrically connect to the PCB boards;

a ground member, being disposed between the two PCB boards, and located on the back edge of the two PCB boards for electrically connecting to the back shielding cover;

an electrical-terminal base, being disposed between the two PCB boards, and located on the lower edge of the two PCB boards;

a plurality of electrical terminals, being disposed on the electrical-terminal base, wherein one end of the electrical terminals are extended downward and out of the electrical-terminal base, and passing through the position-limiting board so as to expose out of the housing; moreover, the other end of the electrical terminals are extended out of the electrical-terminal base and connected to the two PCB boards;

at least one filter module is disposed between the two PCB boards;

wherein each the LED module comprises:

a plurality of LED components, being disposed on the two PCB boards, and located at the front edge of the two PCB boards;

a plurality of light guiding members, being disposed in front of the plurality of LED components;

at least one first terminal module, being disposed between two adjacent electrical modules, and each the first terminal module comprises a plurality of LED terminals; wherein one end of the LED terminals are respectively welded on the welding notches of the PCB boards, and the other end of the LED terminals are extended downward and out of the position-limiting board.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe an electrical connector structure according to the present invention, embodiments of the present invention will be described in detail with reference to the attached drawings hereinafter.

Figure 1:
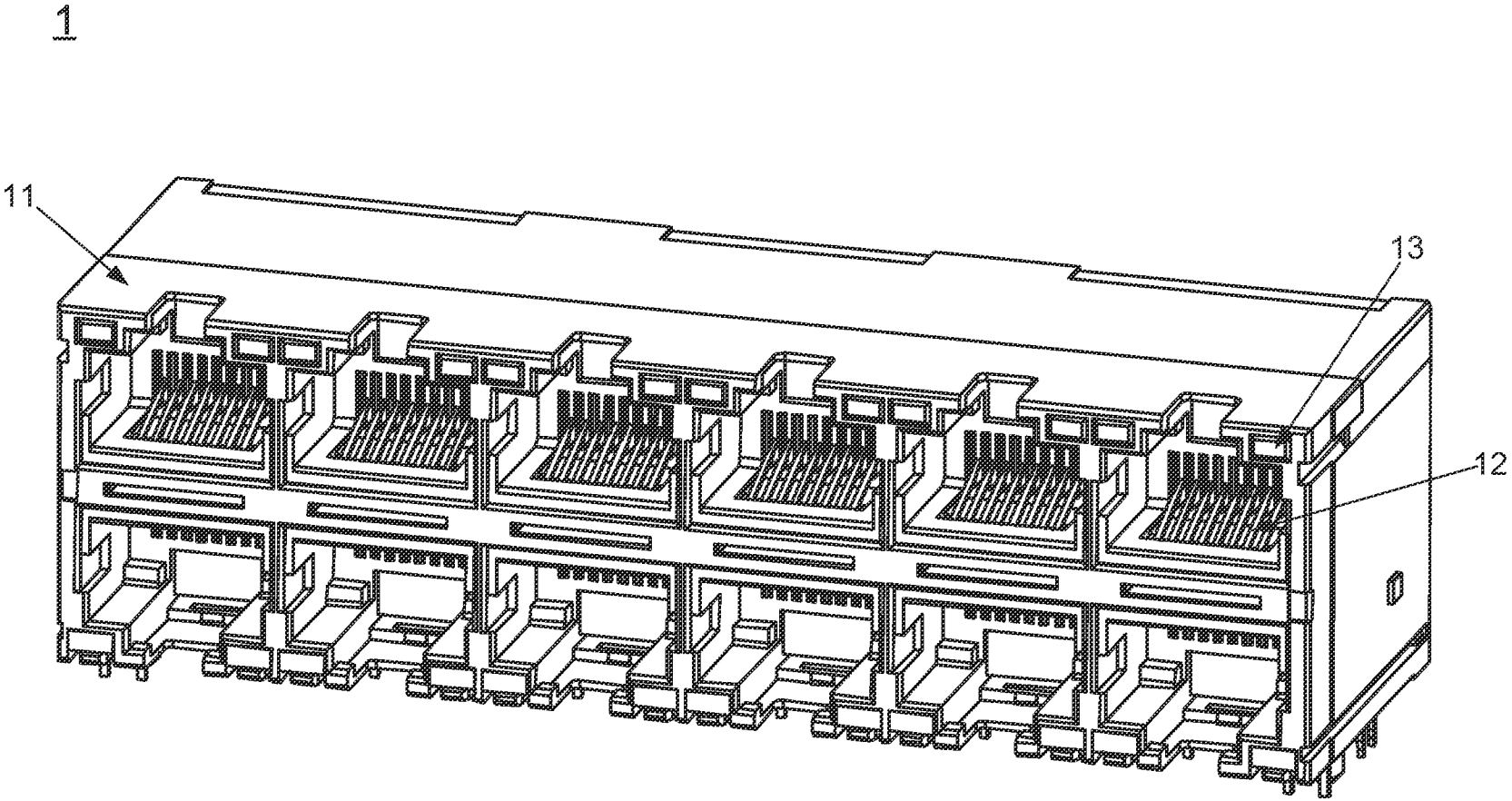
FIG. 1 is a stereo view of an electrical connector structure according to the present invention.

With reference to FIG. 1, there is shown a stereo view of an electrical connector structure according to the present invention. As shown in FIG. 1, the electrical connector structure 1 of the present invention includes a housing 11, a plurality of electrical modules 12 and a plurality of LED modules 13, wherein the plurality of electrical modules 12 and the plurality of LED modules 13 are disposed in the housing 11.

Figure 2:
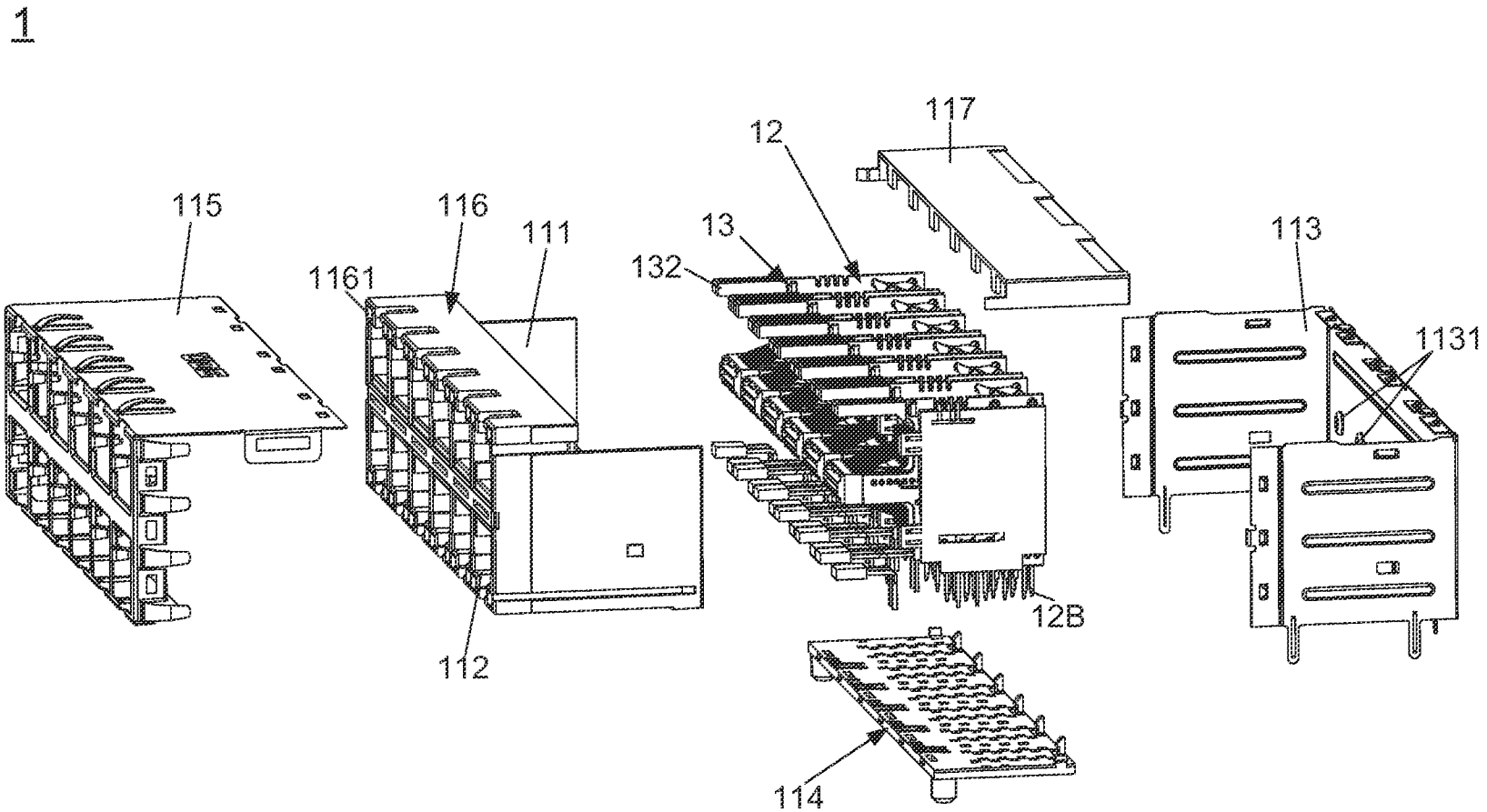
FIG. 2 is an exploded view of the electrical connector structure.

Please refer to FIG. 2, which illustrates an exploded view of the electrical connector structure. As shown in FIG. 2, the housing 11 comprises a base 116 having a plurality of accommodating spaces 111 and a plurality of receiving spaces 112, wherein the receiving spaces 112 are located at the front side of the base 116 opposite to the accommodating spaces 111. Moreover, the housing 11 further comprises a back shielding cover 113 disposed on the back side of the base 116, a position-limiting board 114 disposed on the bottom of the base 116, a front shielding cover 115 disposed on the front side of the base 116, and an upper shielding cover 117 disposed on the base 116. Besides, the back shielding cover 113, the position-limiting board 114, the front shielding cover 115, and the upper shielding cover 117 are combined with each other and covered the base 116, moreover, a plurality of light guiding holes 1161 are formed on the base 116 and a plurality of welding protrusions 1131 are formed on the internal wall of the back shielding cover 113. Furthermore, the electrical modules 12 are disposed in the accommodating spaces 111 corresponding to the receiving spaces 112, and the LED modules 13 are disposed in the accommodating spaces 111, wherein the LED modules 13 are located in front of the electrical modules 12. In addition, each the LED module 13 comprises a plurality of light guiding members 132, and respectively embedded in the plurality of light guiding holes 1161.

Figure 3:
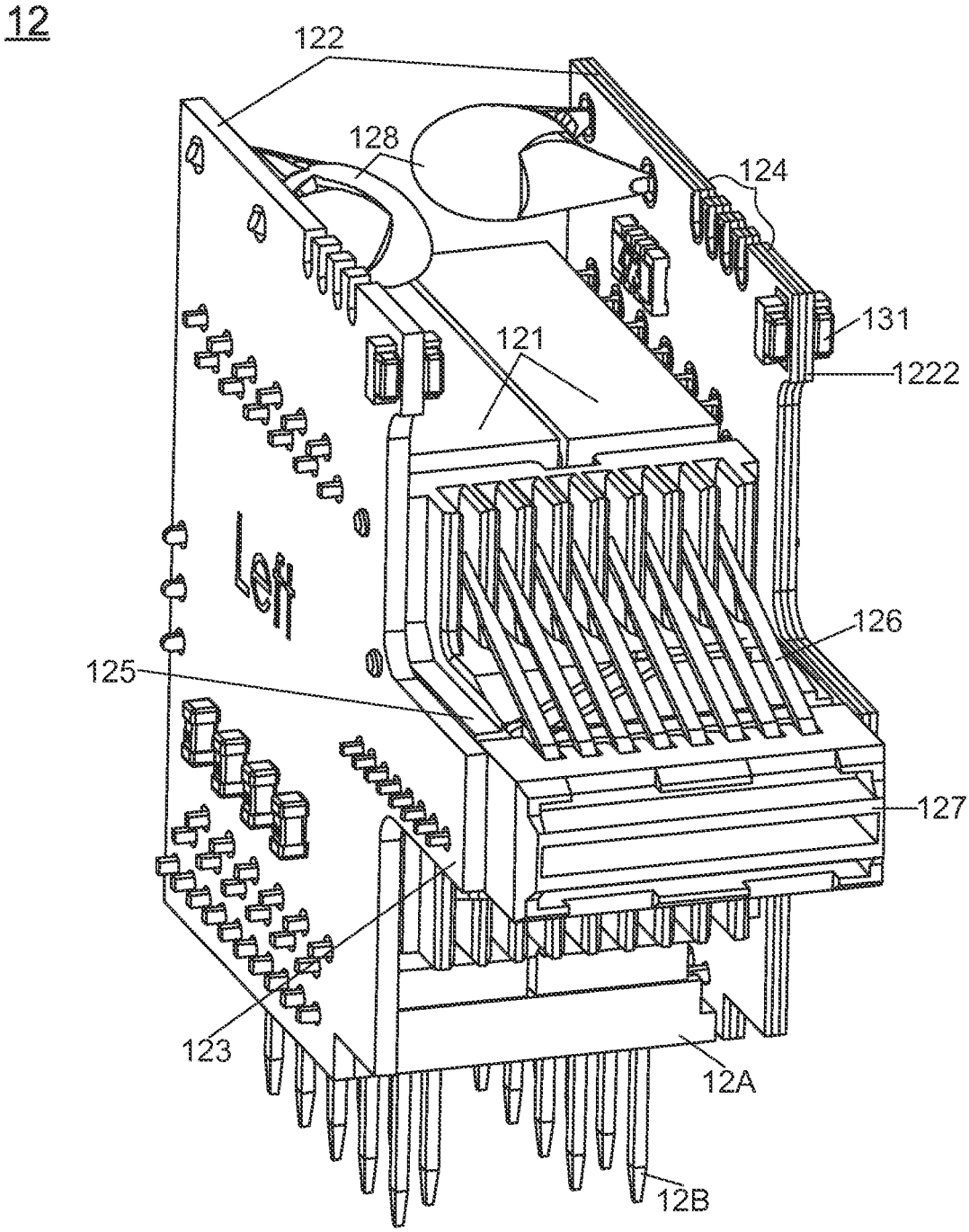
FIG. 3 is a stereo view of an electrical module of the electrical connector structure.
Figure 4:
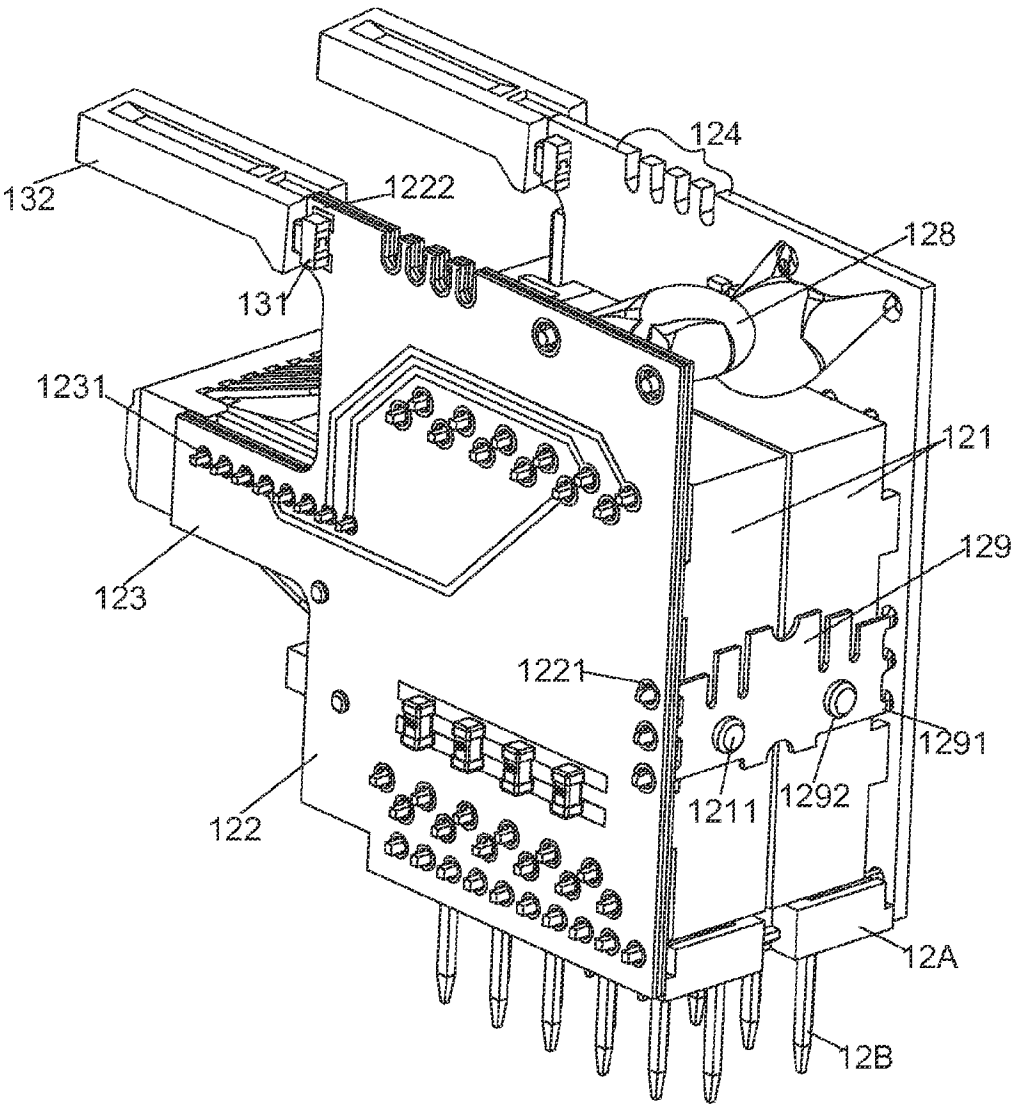
FIG. 4 is a second stereo view of the electrical module.
Figure 5:
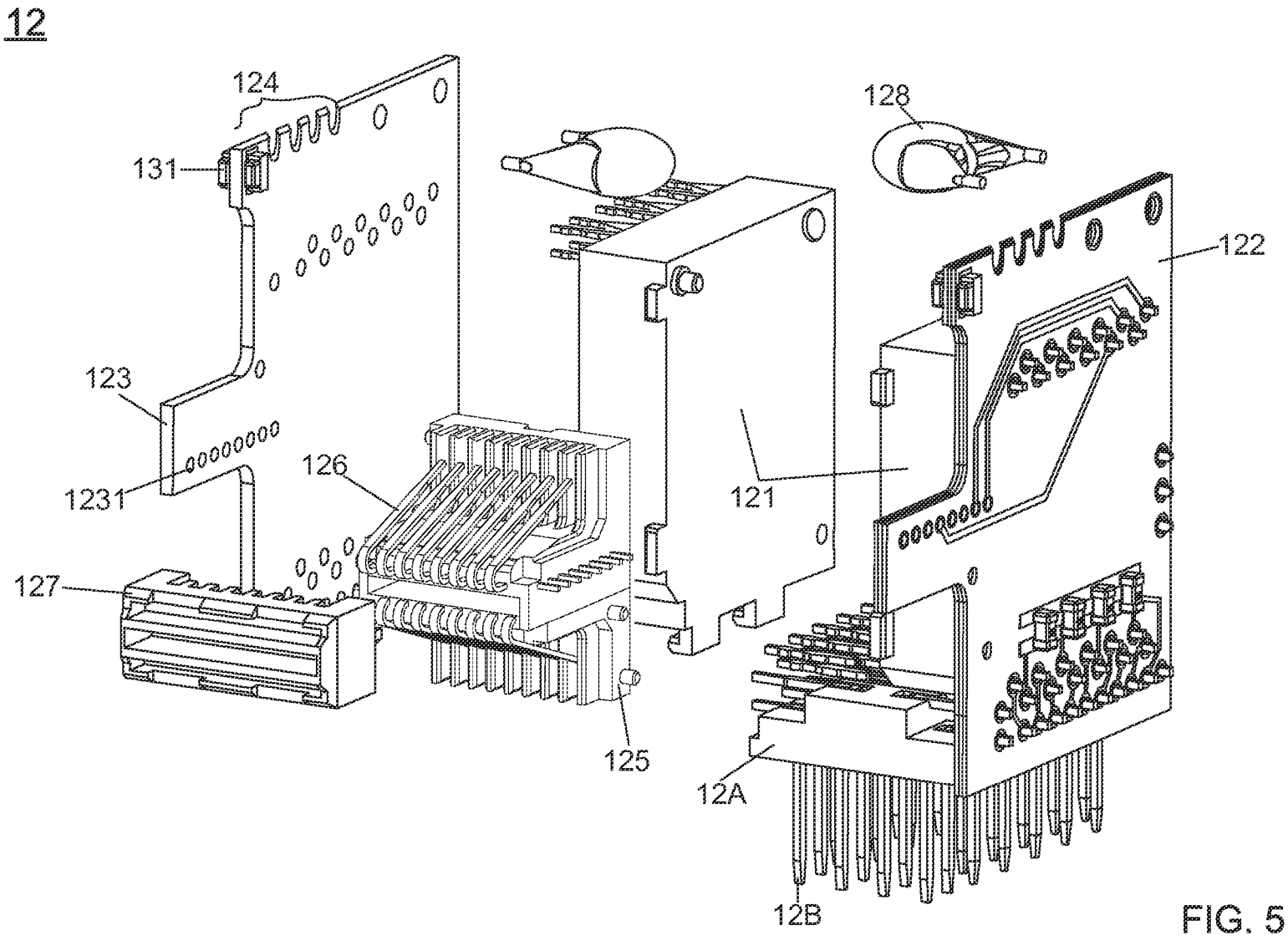
FIG. 5 is an exploded view of the electrical module.

Refer to FIG. 3, FIG. 4, and FIG. 5, there are shown a stereo view, a second stereo view, and an exploded view of the electrical module 12. As shown in FIG. 3, FIG. 4, and FIG. 5, each electrical module 12 comprises two PCB boards 122 and two filter modules 121 disposed between the two PCB boards 122, and each PCB board 122 has an extended portion 123 and a plurality of welding notches 124. Moreover, the electrical module 12 further comprises a terminal base 125 disposed in front of the filter modules 121, two capacitances 128 disposed above the filter modules 121, a ground member 129 disposed behind the filter modules 121, and an electrical-terminal base 12A disposed under the filter modules 121. According to the present invention, a spacing block 127 is disposed on the front side of the terminal base 125, and a plurality of RJ terminals 126 are disposed on the upside and the downside of the terminal base 125, wherein one end of the plurality of RJ terminals 126 are extended out of the two lateral sides of terminal base 125 from the internal of the terminal base 125, and the other end of the RJ terminals 126 being exposed out of the upside and the downside of the terminal base 125. Moreover, the end of the plurality of RJ terminals 126 connected to the two PCB boards 122, and welded in a plurality of extended-portion welding holes 1231 formed on the extended portion 123, in addition, the extended-portion welding holes 1231 are oppositely arranged to up-row welding holes and down-row welding holes on the two extended portions 123. Therefore, the RJ terminals 126 can be avoided from being welded onto the center position of the PCB board 122 such that there would remained more space for disposing the filter modules 121; besides, the arrangement of the extended-portion welding holes 1231 would increase the space between the extended-portion welding holes 1231, so as to improve the layout of the PCB boards 122.

Furthermore, the pins of the two capacitances 128 are respectively and electrically connected to the PCB boards 122, and the two ends of the ground member 129 are formed with a plurality of ground pins 1291 and the back edge of the two PCB boards 122 are provided with a plurality of welding holes 1221, such that the ground pins 1291 are respectively welded in the welding holes 1221. Wherein a plurality of locating holes 1292 are formed on the ground member 129, and the filter module 121 has a plurality of locating pillars 1211, such that the ground member 129 is located on the plurality of locating pillars 1211 by the plurality of locating holes 1292; besides, the ground member 129 is connected to the welding protrusion 1131 by laser welding process. Through the designed structure of the capacitances 128 and the ground member 129 above, the assembly difficulty of the grounded structure of the capacitances 128 could be improved, such that the manufacturing cost of the electrical connector would be reduced.

As shown in FIG. 4, each electrical module 12 further comprises a plurality of electrical terminals 12B disposed on the electrical-terminal base 12A, wherein one end of the electrical terminals 12B are extended downward and out of the electrical-terminal base 12A, and passing through the position-limiting board 114 so as to expose out of the housing 11; moreover, the other end of the electrical terminals 12B are extended out of the electrical-terminal base 12A and connected to the two PCB boards 122. In addition, a LED extended portion 1222 is formed on the front edge of each of the PCB boards 122, and the front edge of each LED extended portion 1222 is aligned the end of the light guiding member 132, moreover, the LED components 131 are respectively located on the both sides of the LED extended portion 1222. Therefore, the status of the LED components 131 could be displayed on the front side of the housing 11 by the light guiding member 132, so as to avoid disposing an extra PCB board on the front side of the electrical module, further reduce the process and the cost of manufacturing the electrical connector.

Figure 6:
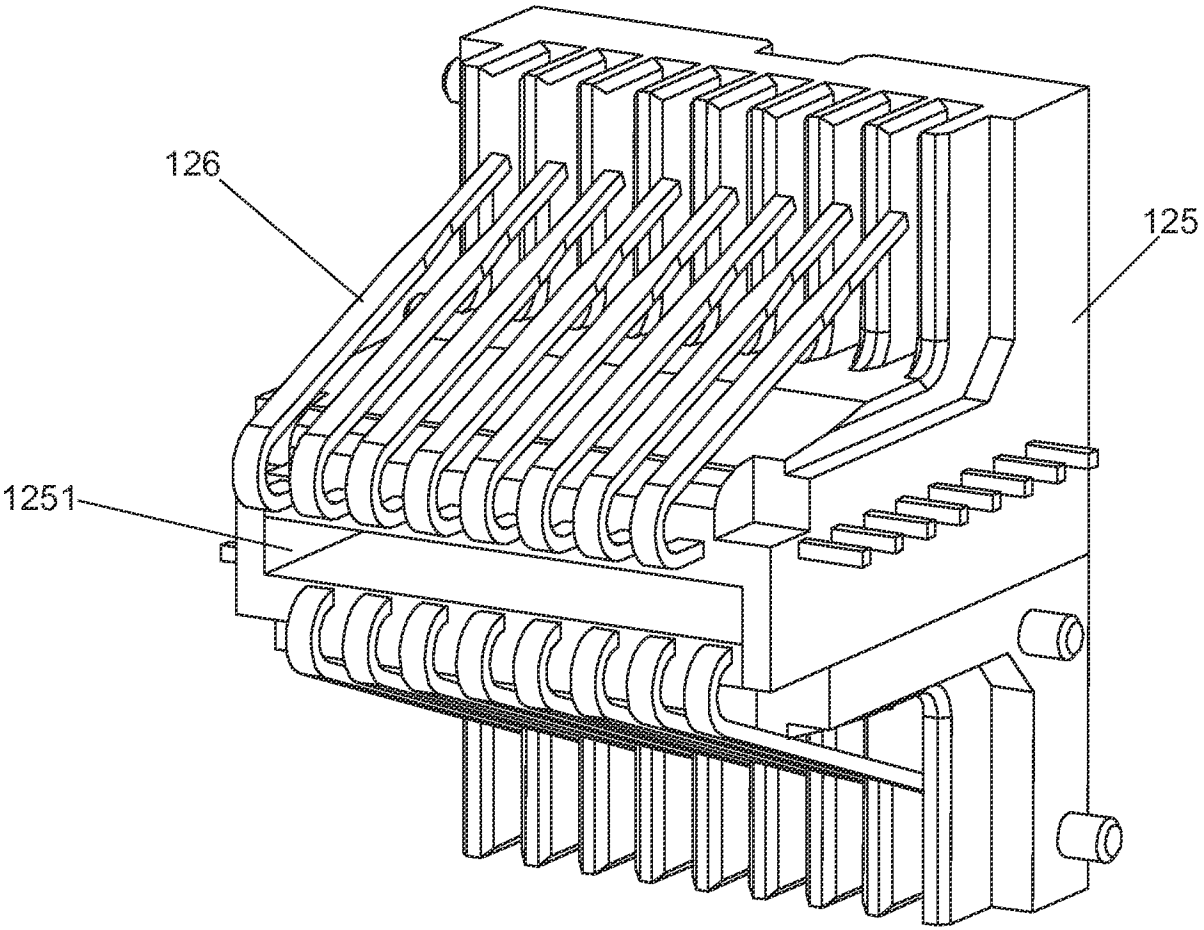
FIG. 6 is an assembly stereo view of a terminal base, RJ terminals and a spacing block of the electrical connector structure.
Figure 7:
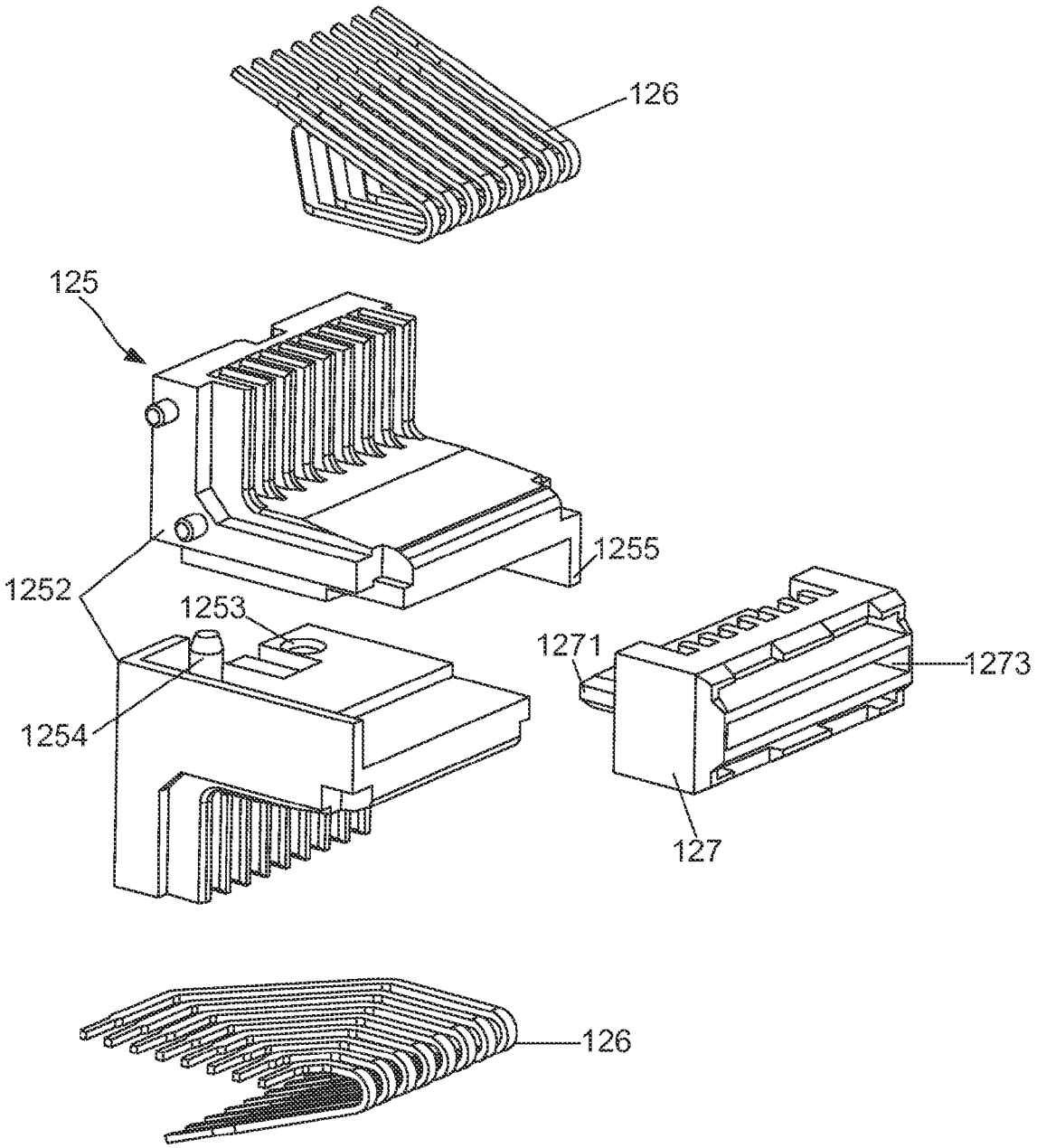
FIG. 7 is an exploded view of the terminal base, the RJ terminals and the spacing block.

Then, please refer to FIG. 6 and FIG. 7, there are shown a stereo view and an exploded view of a terminal base, RJ terminals, and a spacing block of the electrical connector structure. As shown in FIG. 6 and FIG. 7, the plurality of RJ terminals 126 are disposed on the upside and downside of the terminal base 125 by way of mirror-symmetry arrangement, and the spacing block 127 is inserted into the front side of the terminal base 125 through a protrusion tongue 1271 thereof. Moreover, the terminal base 125 is consisted of a pair of L-shaped blocks 1252, and each the L-shaped block 1252 having a L-shaped block locating hole 1253 and a L-shaped block locating pillar 1254, wherein the L-shaped block locating pillar 1254 of one L-shaped block 1252 is embedded to the L-shaped block locating hole 1253 of the other one L-shaped block 1252. Furthermore, each the L-shaped block 1252 further comprises a flange member 1255, and the two flange members 1255 enclosing to a slot 1251 when the pair of L-shaped blocks 1252 are combined to the terminal base 125, wherein the slot 1251 is located on the front side of the terminal base 125.

Figure 8:
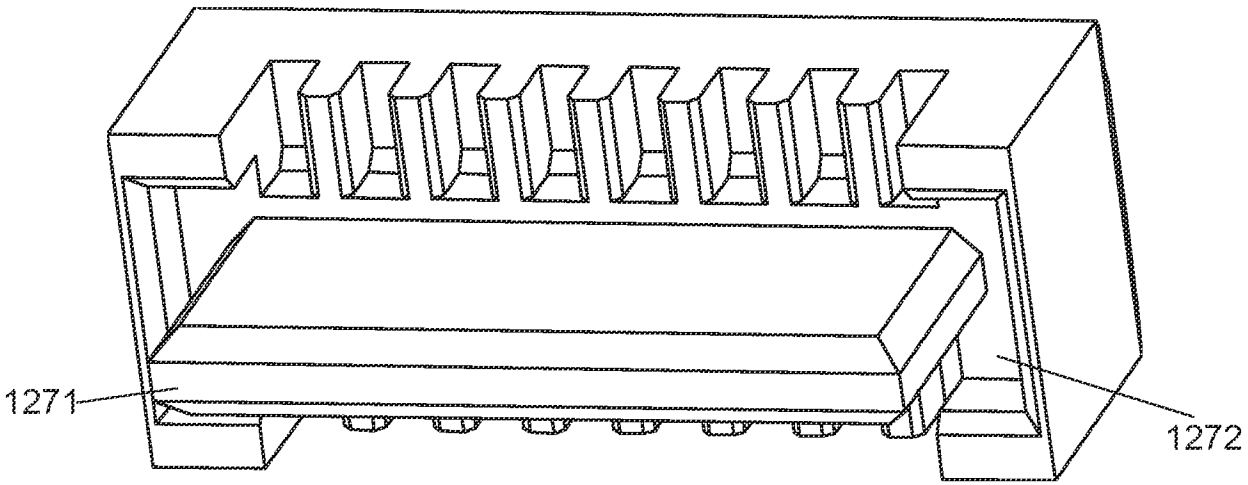
FIG. 8 is a stereo view of the spacing block.

With reference to FIG. 7 and FIG. 8, wherein FIG. 8 shows a stereo view of the spacing block. As shown in FIG. 7 and FIG. 8, a groove 1272 is formed around the root of the protrusion tongue 1271 for making the L-shaped blocks 1252 be partially embedded into the groove 1272; moreover, a slotted hole 1273 is formed on the front side of the spacing block 127, and the bottom of the slotted hole 1273 is formed on the inserted tongue 1271. Through the disposing of the spacing block between the RJ terminals, the adjacent RJ terminals can be avoided from occurring short circuit, so as to provide the function of protecting and improve the product safety. In addition, the deformation of the spacing block 127 under process of production could be avoid by the disposing of the slotted hole 1273 of the spacing block 127, so as to improve the production quality.

Figure 9:
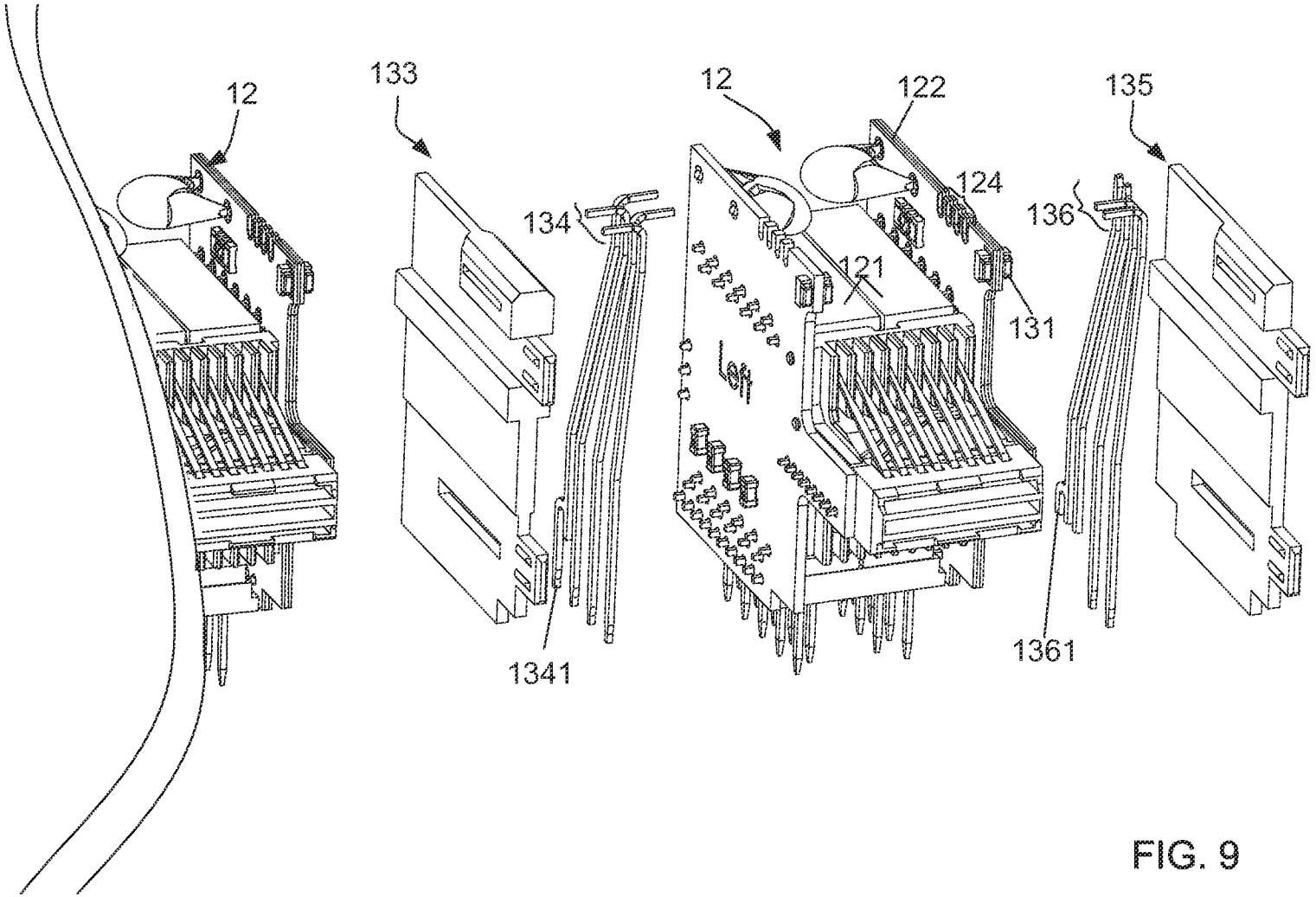
FIG. 9 is a schematic assembly diagram of the electrical modules and terminal modules of the electrical connector structure.
Figure 10:
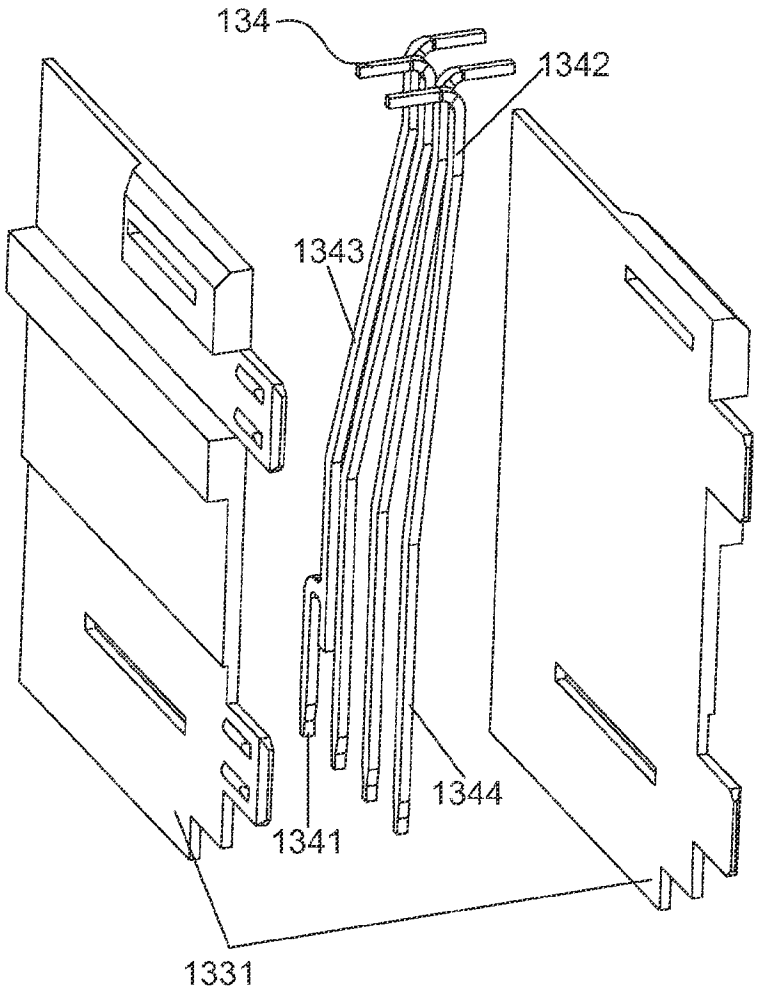
FIG. 10 is a stereo view of the first terminal module of a LED module of the electrical connector structure.

Refer to FIG. 9 and FIG. 10, there are shown a schematic assembly diagram of electrical modules and terminal modules of the electrical connector structure and a stereo view of the first terminal module of a LED module of the electrical connector structure. As shown in FIG. 9 and FIG. 10, each the LED module 13 further comprises a terminal module 133 disposed between two adjacent electrical modules 12, wherein the first terminal module 133 comprises a pair of modeling half-boards 1331 and four LED terminals 134 partially embedded between the pair of modeling half-boards 1331. Moreover, the upper ends of the adjacent LED terminals 134 are respectively bended to the lateral sides for welding on the welding notches 124 of the two adjacent electrical modules 12, and the other end of the LED terminals 134 are extended downward and out of the position-limiting board 114. Furthermore, the distance between the lower ends of two adjacent LED terminals 134 is greater than the distance between the upper ends of the two adjacent LED terminals 134; besides each the LED terminal 134 comprises an upper portion 1342, a lower portion 1344 and a middle portion 1343 connecting with the upper portion 1342 and the lower portion 1344, and a bent angle is formed between the upper portion 1342 and the lower portion 1344.

In addition, the four LED terminals 134 are orderly arranged on one lateral side of the filter module 121 from the back edge to the front edge of the lateral side, and the LED terminal 134 most close to the back edge of the lateral side of the filter module 121 having a η-shaped terminal 1341 on the lower end thereof; wherein the η-shaped terminal 1341 consists of one short pin and one long pin, moreover, the height of the long pin is equal to the height of the lower end of the other three LED terminals 134, and height 1331 of the short pin is higher than the height of the lower end of the other three LED terminals 134.

With reference to FIG. 9, the electrical connector structure 1 further comprises two second terminal modules 135 disposed on the two inner lateral sides thereof, wherein each the second terminal module 135 comprises four second LED terminals 136 arranged on the other one lateral side of the filter module 121 from the back edge to the front edge of the lateral side. Moreover, one end of the two second LED terminal 136 most close to the back edge of the lateral side of the filter module 121 is bent to the a lateral side for welding on the welding notches 124 of the adjacent electrical module 12, and the other end thereof is extended downward and out of the position-limiting board 114. Furthermore, the second LED terminal 136 most close to the back edge of the lateral side of the filter module 121 having a ∩-shaped terminal 1361 on the lower end thereof; in addition, the height of the lower end of the second LED terminal 136 adjacent to the second LED terminal 136 having the ∩-shaped terminal 1361 being equal to the height of the ∩-shaped terminal 1361, and the height of the lower end of the other two second LED terminals 136 is lower than the ∩-shaped terminal 1361.

Figure 11:
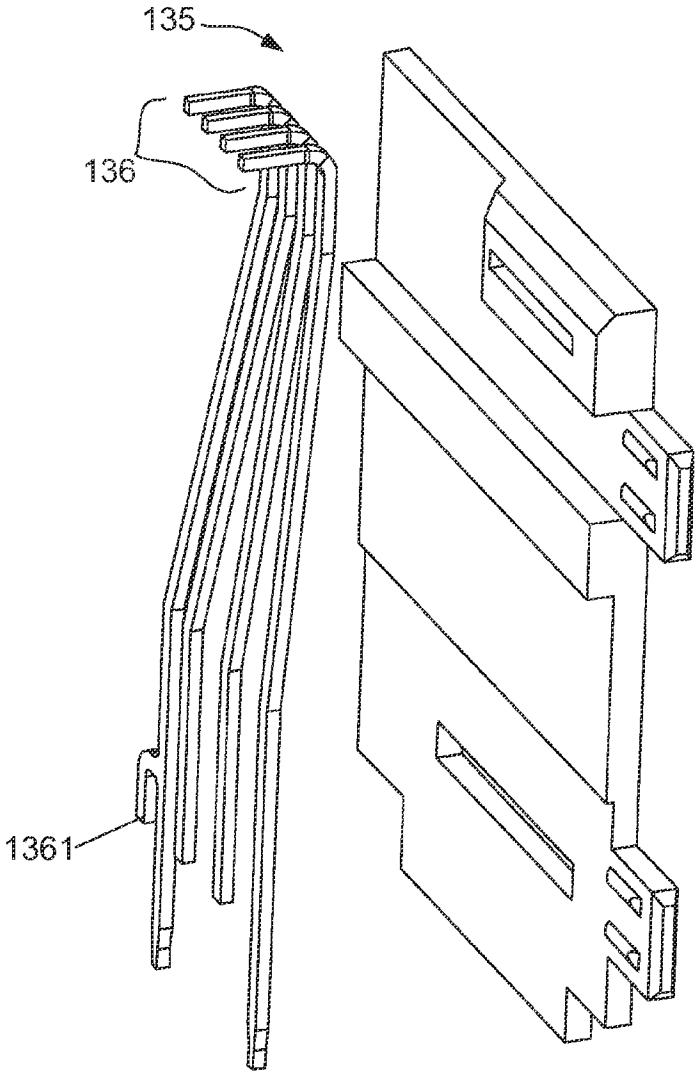
FIG. 11 is a stereo view of the second terminal modules of the implemental embodiment of the second LED terminals.

Besides, the electrical connector structure of the present invention also includes a second embodiment for the second LED terminals. Please refer to FIG. 11, which illustrates a stereo view of the second terminal modules of second embodiment of the electrical connector structure. As shown in FIG. 11, the upper ends of the four second LED terminals 136 are bended to a lateral side for welding on the welding notches 124 of the adjacent electrical module 12. In addition, the second LED terminal 136 most close to the back edge of the lateral side of the filter module 121 having a second η-shaped terminal 1362 on the lower end thereof; wherein the second η-shaped terminal 1362 consists of one short pin and one long pin, moreover, the height of the long pin is equal to the height of the lower end of the second LED terminal 136 most close to the front edge of the lateral side of the filter module 121, and height of the short pin is equal to the height of the lower end of the other two second LED terminals 136.

Via disposing of the first terminal module 133 and the second terminal module 135, so as to reduce the bending of the LED terminal 134 and the second LED terminal 136 for reducing the difficulty of LED terminals welding on the PCB board; furthermore, the difficulty and the cost of manufacturing the electrical connector would be further reduced.

Figure 12:
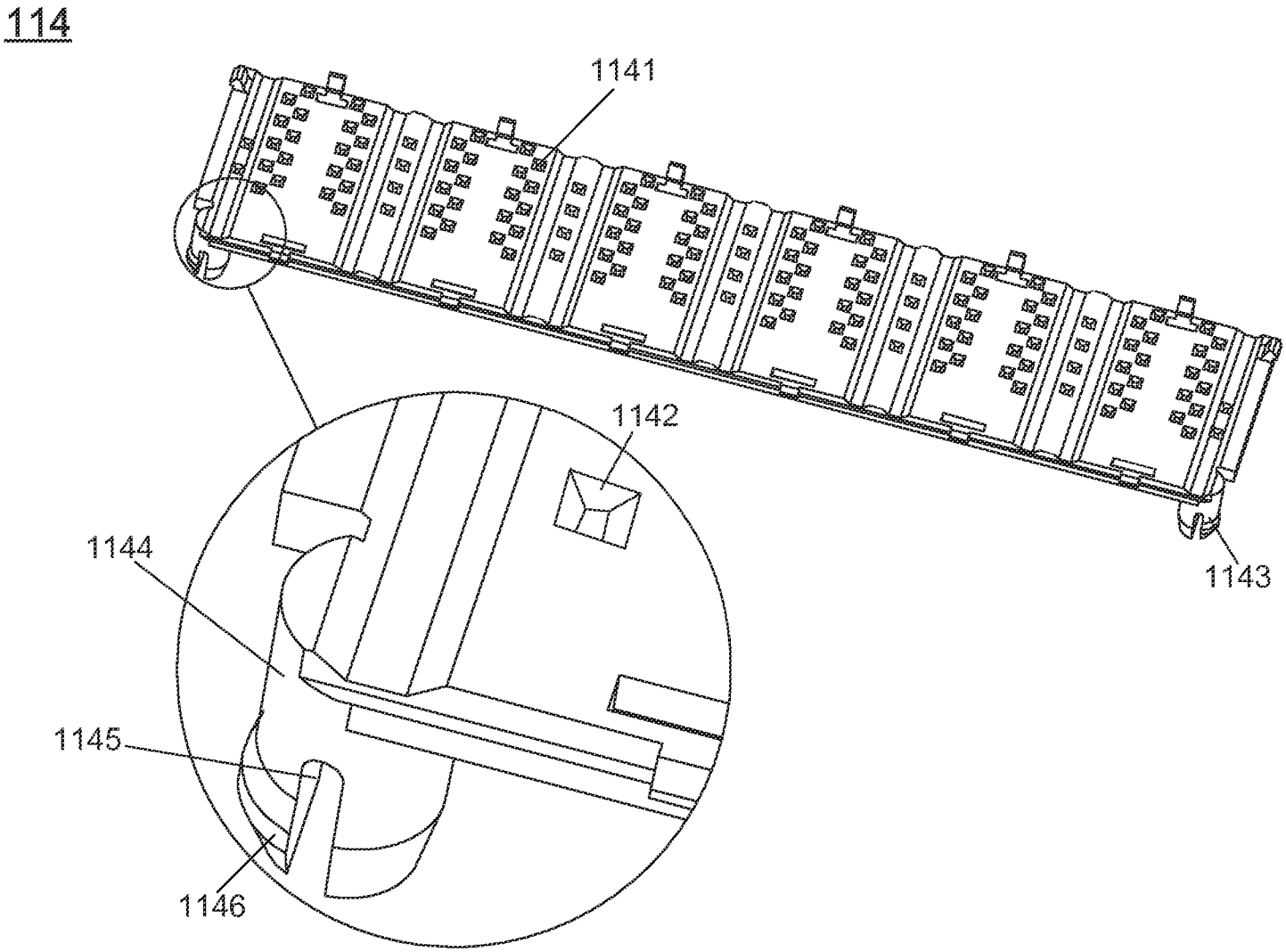
FIG. 12 is a stereo view of a position-limiting board.

Please refer to FIG. 12, which illustrates a stereo view of a position-limiting board to the present invention. As shown in FIG. 12, the position-limiting board 114 comprises a plurality of position-limiting holes 1141 for respectively receiving the electrical terminals 12B, the LED terminals 134, and the second LED terminals 136, wherein the entrance of each the position-limiting hole 1141 is formed with a guiding portion 1142. Moreover, the position-limiting board 114 further comprises two locking posts 1143, being respectively disposed on the two ends of the downside of the position-limiting board 114, wherein each the locking post 1143 has a cylindrical end 1144, and each of the cylindrical ends 1144 are formed with a separating slot 1145 and an arc-shaped buckle 1146. Through the disposing of the position-limiting board 114, the electrical terminals 12B, the LED terminals 134, and the second LED terminals 136 could be received; furthermore, the disposing of the guiding portion 1142 would improve the assembly efficiency of the position-limiting board 114. Besides, the electrical connector structure 1 could be installed on the other equipment via the disposing of the locking posts 1143.

Through above descriptions, the constituting elements of the related technology features of the electrical connector structure of the present invention have been clearly and completely introduced; in summary, the present invention has the following advantages:

1. Through the disposing of the extended portion of the PCB board, the RJ terminals can be avoided from being welded onto the center position of the PCB board; therefore, there would be remained more space for disposing the filter modules, so as to increase the internal space utility of the electrical connector structure.
2. Through welding the pins of the capacitances on the PCB boards and disposing the ground member for connecting the PCB board and the back shielding cover, so as to replace the conventional way of directly pulling the pins of the capacitances out of the back shielding cover and welding the pins on the back shielding cover; therefore, the difficulty and the time of assembly would be reduced such that the production efficiency of the electrical connector would be improved.
3. Through disposing the LED extended portion on the front edge of the PCB board and locating the LED components on the lateral sides of the LED extended portion, so as to replace the conventional way of installing one more PCB board on the front side of the electrical module for the disposing of the LED components; therefore, the difficulty and the cost of manufacturing the electrical connector would be reduced.
4. Through the disposing of the spacing block between the RJ terminals, the adjacent RJ terminals can be avoided from occurring short circuit, so as to provide the function of protecting and improve the product safety.
5. Through the disposing of the first terminal modules and the second terminal modules, so as to replace the conventional way of combining the repeatedly bent LED terminals with the LED fixing boards for installing them into the electrical connector; therefore, the difficulty and the cost of manufacturing the electrical connector would be further reduced.
6. Through the disposing of the position-limiting board which is formed with position-limiting holes thereon for receiving electrical terminals and LED terminals, so as to replace the conventional way of respectively disposing the position-limiting holes on different supporting boards; therefore, the assembling errors would be avoided and the assembling quality would be improved.

The above description is made on embodiments of the present invention. However, the embodiments are not intended to limit scope of the present invention, and all equivalent implementations or alterations within the spirit of the present invention still fall within the scope of the present invention.

What is claimed is:

1. An electrical connector structure 1, comprising:

a housing 11, comprising at least one accommodating space 111 and at least one receiving space 112, and the housing 11 further comprising a back shielding cover 113 and a position-limiting board 114 disposed on the bottom thereof;

at least one electrical module 12, being disposed in the at least one accommodating space 111 corresponding to the at least one receiving space 112; and at least one LED module 13, being disposed in the at least one accommodating space 111;

wherein each electrical module 12 comprises:

two PCB boards 122, being respectively formed with a plurality of welding notches 124;

a terminal base 125, being disposed between the two PCB boards 122, and located on the front edge of the two PCB boards 122;

a plurality of RJ terminals 126, being disposed on the upside and the downside of the terminal base 125, wherein one end of the plurality of RJ terminals 126 are extended out of the two lateral sides of terminal base 125 from the internal of the terminal base 125, and the other end of the RJ terminals 126 being exposed out of the upside and the downside of the terminal base 125;

a spacing block 127, being disposed on the front side of the terminal base 125;

a plurality of capacitances 128, being disposed on the PCB boards 122, and located on the upper side of the two PCB boards 122, wherein the pins of the plurality of capacitances 128 electrically connect to the PCB boards 122;

a ground member 129, being disposed between the two PCB boards 122, and located on the back edge of the two PCB boards 122 for electrically connecting to the back shielding cover 113;

an electrical-terminal base 12A, being disposed between the two PCB boards 122, and located on the lower edge of the two PCB boards 122;

a plurality of electrical terminals 12B, being disposed on the electrical-terminal base 12A, wherein one end of the electrical terminals 12B are extended downward and out of the electrical-terminal base 12A, and passing through the position-limiting board 114 so as to expose out of the housing 11; moreover, the other end of the electrical terminals 12B are extended out of the electrical-terminal base 12A and connected to the two PCB boards 122;

wherein each the LED module 13 comprises:

a plurality of LED components 131, being disposed on the two PCB boards 122, and located at the front edge of the two PCB boards 122;

a plurality of light guiding members 132, being disposed in front of the plurality of LED components 131;

at least one first terminal module 133, being disposed between two adjacent electrical modules 12, and each the first terminal module 133 comprises a plurality of LED terminals 134; wherein one end of the LED terminals 134 are respectively welded on the welding notches 124 of the PCB boards 122, and the other end of the LED terminals 134 are extended downward and out of the position-limiting board 114.

2. The electrical connector structure of claim 1, wherein the housing 11 further comprises:

a front shielding cover 115, being combined with the back shielding cover 113;

a base 116, being disposed behind the front shielding cover 115 and formed with the at least one accommodating space 111 and the at least one receiving space 112; wherein the at least one receiving space 112 is located at the front side of the base 116 opposite to the at least one accommodating space 111; and an upper shielding cover 117, being disposed on the electrical module 12, and the upper shielding cover 117 being combined with the base 116.

3. The electrical connector structure of claim 1, wherein the electrical module 12 further comprises at least one filter module 121 is disposed between the two PCB boards 122; wherein, the terminal base 125 is disposed in front of the filter module 121 and the capacitances 128 are disposed above the filter module 121, moreover, the ground member 129 is disposed behind the filter module 121 and the electrical-terminal base 12A is disposed under the filter module 121.

4. The electrical connector structure of claim 1, wherein each of the two PCB boards 122 have an extended portion 123, and the end of the plurality of RJ terminals 126 connected to the two PCB boards 122 being welded on the extended portion 123.

5. The electrical connector structure of claim 1, wherein the two ends of the ground member 129 are formed with a plurality of ground pins 1291 and the back edge of the two PCB boards 122 are provided with a plurality of welding holes 1221, such that the ground pins 1291 are respectively welded in the welding holes 1221, furthermore, a plurality of locating holes 1292 are formed on the ground member 129.

6. The electrical connector structure of claim 1, wherein a plurality of welding protrusions 1131 are formed on the internal wall of the back shielding cover 113, and the ground member 129 is connected to the welding protrusion 1131 by laser welding process.

7. The electrical connector structure of claim 1, wherein a LED extended portion 1222 is formed on the front edge of each of the PCB boards 122, and the front edge of each LED extended portion 1222 is aligned the end of the light guiding member 132, moreover, the LED components 131 are respectively located on the both sides of the LED extended portion 1222.

8. The electrical connector structure of claim 1, wherein the number of the plurality of LED terminals 134 is four, moreover, the upper ends of the adjacent LED terminals 134 are respectively bended to the lateral sides for welding on the welding notches 124 of the two adjacent electrical modules 12.

9. The electrical connector structure of claim 1, wherein the first terminal module 133 further comprises a pair of modeling half-boards 1331, and the LED terminals 134 are partially embedded between the pair of modeling half-boards 1331.

10. The electrical connector structure of claim 1, wherein the plurality of RJ terminals 126 are disposed on the upside and downside of the terminal base 125 by way of mirror-symmetry arrangement, and the spacing block 127 is inserted into the front side of the terminal base 125 through a protrusion tongue 1271 thereof.

11. The electrical connector structure of claim 2, wherein a plurality of light guiding holes 1161 are formed on the base 116 for respective embedding the plurality of light guiding members 132.

12. The electrical connector structure of claim 3, wherein the filter module 121 has a plurality of locating pillars 1211, and the ground member 129 is located on the plurality of locating pillars 1211 by the plurality of locating holes 1292.

13. The electrical connector structure of claim 4, wherein the extended portion 123 comprises a plurality of extended-portion welding holes 1231, and the extended-portion welding holes 1231 are oppositely arranged to up-row welding holes and down-row welding holes on the two extended portions 123.

14. The electrical connector structure of claim 8, wherein the distance between the lower ends of two adjacent LED terminals 134 is greater than the distance between the upper ends of the two adjacent LED terminals 134.

15. The electrical connector structure of claim 8, wherein the four LED terminals 134 are orderly arranged on one lateral side of the filter module 121 from the back edge to the front edge of the lateral side, and the LED terminal 134 most close to the back edge of the lateral side of the filter module 121 having a η-shaped terminal 1341 on the lower end thereof; wherein the η-shaped terminal 1341 consists of one short pin and one long pin, moreover, the height of the long pin is equal to the height of the lower end of the other three LED terminals 134, and height 1331 of the short pin is higher than the height of the lower end of the other three LED terminals 134.

16. The electrical connector structure of claim 8, wherein each the LED terminal 134 comprises an upper portion 1342, a lower portion 1344 and a middle portion 1343 connecting with the upper portion 1342 and the lower portion 1344, and a bent angle is formed between the upper portion 1342 and the lower portion 1344.

17. The electrical connector structure of claim 10, wherein the terminal base 125 is consisted of a pair of L-shaped blocks 1252, and each the L-shaped block 1252 having a L-shaped block locating hole 1253 and a L-shaped block locating pillar 1254, wherein the L-shaped block locating pillar 1254 of one L-shaped block 1252 is embedded to the L-shaped block locating hole 1253 of the other one L-shaped block 1252.

18. The electrical connector structure of claim 10, wherein a groove 1272 is formed around the root of the protrusion tongue 1271 for making the L-shaped blocks 1252 be partially embedded into the groove 1272.

19. The electrical connector structure of claim 10, wherein a slotted hole 1273 is formed on the front side of the spacing block 127, and the bottom of the slotted hole 1273 is formed on the inserted tongue 1271.

20. The electrical connector structure of claim 17, wherein each the L-shaped block 1252 further comprises a flange member 1255, and the two flange members 1255 enclosing to a slot 1251 when the pair of L-shaped blocks 1252 are combined to the terminal base 125, wherein the slot 1251 is located on the front side of the terminal base 125.

21. The electrical connector structure of claim 15, the electrical connector structure 1 further comprises two second terminal modules 135 disposed on the two inner lateral sides thereof, wherein each the second terminal module 135 comprises four second LED terminals 136, and the four second LED terminals 136 are arranged on the other one lateral side of the filter module 121 from the back edge to the front edge of the lateral side.

22. The electrical connector structure of claim 21, wherein the second LED terminal 136 most close to the back edge of the lateral side of the filter module 121 having a ∩-shaped terminal 1361 on the lower end thereof; moreover, the height of the lower end of the second LED terminal 136 adjacent to the second LED terminal 136 having the ∩-shaped terminal

1361 being equal to the height of the ∩-shaped terminal 1361, and the height of the lower end of the other two second LED terminals 136 is lower than the ∩-shaped terminal 1361.

23. The electrical connector structure of claim 21, wherein the second LED terminal 136 most close to the back edge of the lateral side of the filter module 121 having a second η-shaped terminal 1362 on the lower end thereof; wherein the second η-shaped terminal 1362 consists of one short pin and one long pin, moreover, the height of the long pin is equal to the height of the lower end of the second LED terminal 136 most close to the front edge of the lateral side of the filter module 121, and height of the short pin is equal to the height of the lower end of the other two second LED terminals 136.

24. The electrical connector structure of claim 23, wherein the position-limiting board 114 comprises:

a plurality of position-limiting holes 1141 for respectively receiving the electrical terminals 12B, the LED terminals 134, and the second LED terminals 136, wherein the entrance of each the position-limiting hole 1141 is formed with a guiding portion 1142; and two locking posts 1143, being respectively disposed on the two ends of the downside of the position-limiting 114, wherein each the locking post 1143 has a cylindrical end 1144, and each of the cylindrical ends 1144 are formed with a separating slot 1145 and an arc-shaped buckle 1146.

* * * * *